United States Patent [19]

Fluck

[11] 4,364,671

[45] Dec. 21, 1982

[54] ELECTRONIC WATCH WITH DISPLAY BY DISCS

[75] Inventor: Josef Fluck, Granges, Switzerland

[73] Assignee: Ebauches, S.A., Switzerland

[21] Appl. No.: 196,774

[22] Filed: Oct. 14, 1980

[51] Int. Cl.[3] ..... G04B 19/04; G04B 33/06

[52] U.S. Cl. ..... 368/221; 368/77; 368/88

[58] Field of Search ..... 368/220, 221, 233, 228, 368/276, 281, 76, 77, 80, 88

[56] References Cited

U.S. PATENT DOCUMENTS

| | | | |
|---|---|---|---|
| 1,949,024 | 2/1934 | Melik-Minassiantz | 368/233 |
| 2,852,908 | 9/1958 | Stern et al. | 368/77 |
| 4,090,352 | 5/1978 | Jeannet et al. | 368/220 |
| 4,274,153 | 6/1981 | Kume et al. | 368/220 X |

FOREIGN PATENT DOCUMENTS

| | | | |
|---|---|---|---|
| 428929 | 12/1948 | Italy | 368/77 |
| 615069 | 1/1980 | Switzerland | 368/76 |

*Primary Examiner*—Roy N. Envall, Jr.

*Assistant Examiner*—Philip H. Leung

*Attorney, Agent, or Firm*—Allegretti, Newitt, Witcoff & McAndrews

[57] ABSTRACT

The invention provides a very thin electronic watch having a casing with a front wall provided with a glass, a rear wall and a side wall connecting the front and rear walls. In the casing there is a spindle substantially perpendicular to the front and rear walls and mounted pivotally with respect to the casing, a toothed transmission wheel secured to the spindle, a "minutes" disc perpendicularly secured to the spindle and provided with a tooth arrangement on its periphery, and an "hours" disc pivotally mounted on the spindle, substantially parallel to the "minutes" disc and provided with a tooth arrangement on its periphery, the "minutes" and "hours" discs being disposed between the glass and the toothed transmission wheel. The casing further has an electric motor, a supply source, a first gear train engaging the rotor of the electric motor and the "minutes" disc and a second gear train engaging the "hours" disc and the transmission wheel.

8 Claims, 4 Drawing Figures

ELECTRONIC WATCH WITH DISPLAY BY DISCS

BACKGROUND OF THE INVENTION

The present invention concerns an electronic watch with a display by means of discs.

It is well known that, in analog watches, the display may be of two main kinds: either by means of hands or pointers which are driven by spindles, or by means of discs which are driven in rotation and which carry marks simulating the hands or pointers. Thus there is for example an hours disc and a minutes disc.

The present invention is concerned solely with the second kind of analog display.

A number of designs have already been proposed, in regard to guiding and driving the discs in rotation. In accordance with Swiss Pat. No. 307,045 which describes a mechanical watch, the hours disc is directly carried and driven by the spring drum cover. The minutes discs are provided with a peripheral tooth arrangement and a gear train engaged with the tooth arrangements of the discs transmits the movement of the hours disc to the minutes disc, in a suitable ratio. This construction is relatively bulky because of the stacked arrangement of the drive member formed by the spring drum and the two discs. In addition, because the two discs are of substantially the same diameter, it is the gear train alone which is required to provide the multiplication ratio. Consequently, the gear train must comprise at least three movement means which are disposed outside the discs. The number of movement means increases the complexity of machining of the bridge members which carry them, and increases the dimensions of the watch. In accordance with Swiss Pat. No. 155,524, the two discs are free to rotate about a spindle and are provided with a tooth arrangement at their respective peripheries. Each disc is driven by a train of movement members, which is disposed outside the discs and which engages with the tooth arrangement. The two trains of movement members are therefore mounted in parallel and are driven by a single drive member.

This design therefore requires a substantial number of movement members. This increases the complexity of the watch and also increases the number of apertures to be made in the bridge members or plates which carry the movement members. In addition, the trains of movement members take up a relatively substantial amount of space.

It will be seen that the two prior art constructions do not represent the optimum design if the watch comprising such discs is required to be as thin as possible. The present-day tendency is towards watches which are as small in thickness as possible, being referred to as "extra-thin" watches.

BRIEF SUMMARY OF THE INVENTION

A first object of the invention is to provide an electronic watch wherein the display discs and the gears for driving the discs take up as small an amount of space as possible.

A second object of the invention is to provide an electronic watch wherein the display discs and the disc drive gears are overall as small in thickness as possible.

A third object of the invention is to provide an electronic watch wherein the disc drive gears are small in number.

A fourth object of the invention is to provide an electronic watch wherein the discs are guided and supported, with the minimum number of components.

A fifth object of the invention is to provide an electronic disc-type watch wherein the mounting of the gears in the watch casing requires only a limited number of machining operations.

To achieve these aims, the watch according to the invention comprises a minutes disc which is mounted fixedly with a spindle on which a toothed wheel is also mounted, close to the bottom on the casing of the watch. The assembly is mounted rotatably with respect to the casing of the watch. An hours disc is mounted freely rotatably on the spindle, preferably between the hours disc and the toothed wheel. The periphery of the two discs is provided with a tooth arrangement. A first movement member connects the motor of the watch to the minutes disc and a second movement member connects the toothed wheel to the hours disc.

Thus, the motor is operatively connected to the minutes disc at its periphery and the movement between the two discs is transmitted by the combination of the shaft provided with its toothed wheel and a movement member which engages with the periphery of the hours disc. The kinematic chain is therefore very simple and comprises only a very limited number of components.

BRIEF DESCRIPTION OF THE DRAWINGS

Other objects and features of the invention will be more clearly apparent from the following description of a preferred embodiment of the invention. The description of an illustrative embodiment is given with reference to the accompanying drawings in which.

DETAILED DESCRIPTION OF THE PREFERRED EMBODIMENT

Figure 1:
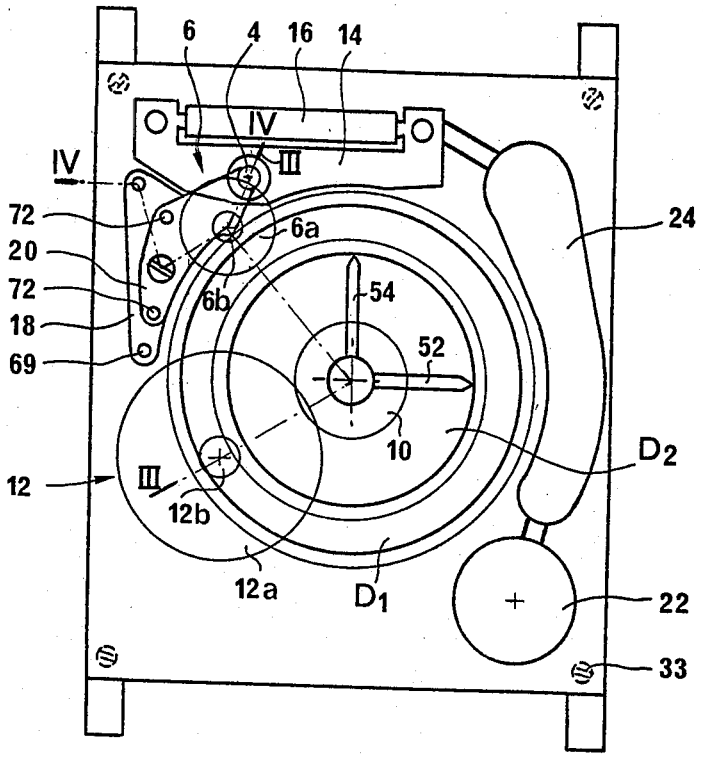
FIG. 1 is a plan view of the watch, essentially showing the transmission of the movement between the motor and the discs.
Figure 2:
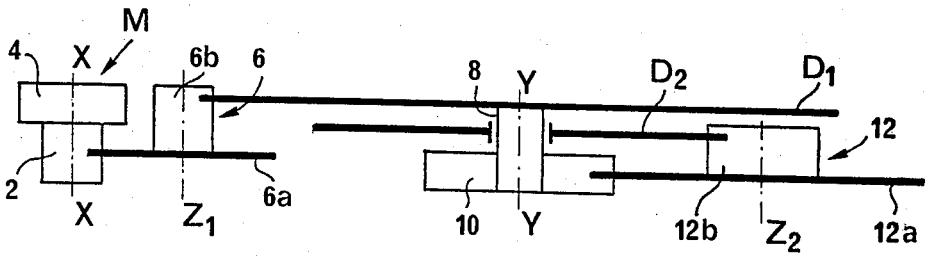
FIG. 2 shows a very highly simplified view in vertical section of a preferred mode of mounting the discs of the watch, with their drive members.

FIGS. 1 and 2 are very highly simplified forms of the kinematic chain for transmitting the movement of the motor M to the minutes disc $D_1$ and the hours disc $D_2$. A pinion 2 mounted on the rotor 4 of the motor M engages with a wheel 6*a* of a first movement means 6. The pinion 6*b* of the movement means 6 engages with the minutes disc $D_1$, the periphery of which is provided with teeth, as will be described hereinafter. The disc $D_1$ is secured to a spindle 8 of which the other end is secured to a toothed wheel 10. The toothed wheel 10 engages with the wheel 12*a* of a second movement means 12. Finally, the pinion 12*b* of the movement means 12 engages with the hours disc $D_2$. The hours disc $D_2$ is mounted idly on the spindle 8.

Thus, the movement means 6 causes rotary movement of the minutes disc $D_1$ and the assembly formed by the spindle 8, the wheel 10 and the movement means 12 transmits the movement of the minutes disc $D_1$ to the hours disc $D_2$. It will be appreciated that the movement means 6 is so calculated that the minutes disc $D_1$ performs one revolution per hour, and the movement means 12 and the wheel 10 are so calculated that the assembly thereof gives a step-down ratio of 1/12th between the speeds of rotation of the two discs. It can already be seen at the present stage that, by virtue of the kinematic chain used, the number of spindles is reduced with respect to the prior art constructions and therefore the number of apertures to be formed for mounting the bearings for such spindles is also reduced. More precisely, there are only four such spindles, namely the spindle of the rotor X—X; the spindle for the discs Y—Y; and the spindles $Z_1$—$Z_1$ and $Z_2$—$Z_2$ for the movement means.

It would also be possible to envisage mounting the hours disc $D_2$ above the minutes disc $D_1$. The disc $D_2$ is obviously still mounted idly on the spindle. However, this design appears to be less advantageous.

FIG. 1 also shows in simplified form the stator of the motor M with its armature 14 and its coil 16. It also shows the lower bridge or plate member 18 and the upper bridge or plate member 20 for mounting the rotor 4 of the motor and the movement means 6. This part of the watch will be described in greater detail hereinafter with reference to FIG. 4. This FIGURE finally shows the installation of the battery 22 and the printed circuit 24 which essentially carries the integrated circuit and the oscillator, as is well known.

Figure 3:
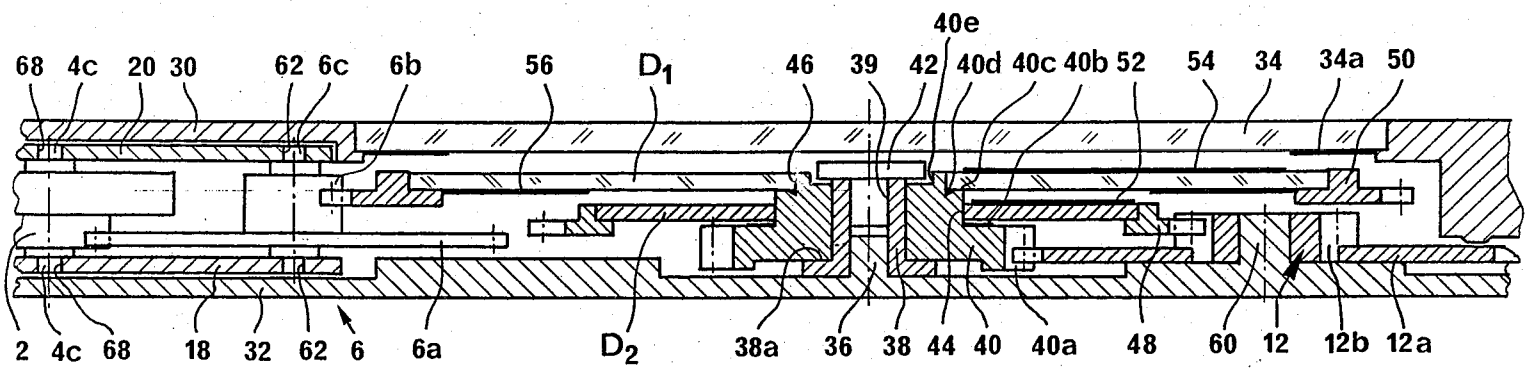
FIG. 3 is a view of details in vertical section taken along line III—III in FIG. 1.

FIG. 3 shows a detail view of a preferred embodiment and manner of mounting the discs and the train of gears connecting the motor to the discs.

The casing of the watch comprises a rim member 30 and a body portion 32 which are assembled by way of their peripheries, by means of screws as indicated at 33 in FIG. 1. The rim member 20 in which the glass 34 is mounted forms the front wall of the casing while the body portion 32 forms the rear wall. Finally, the rim portions of the body portion 32 and the rim member 30 together form a side wall which forms the connection between the front and rear walls. The two front and rear walls are substantially flat and parallel to each other.

The minutes disc $D_1$ and the hours disc $D_2$ are mounted within the casing, in the following manner:

A lug 38 provided with a bore 39 therethrough is fitted around a lug 36 which forms an integral part of the body portion 32. This assembly defines the axis of pivotal movement of the discs $D_1$ and $D_2$. A minutes disc wheel 40 is mounted freely rotatably on the lug 38. The wheel 40 is held in respect of translatory movement by a stud 42 which is fitted into the hole 39 in the lug 38. The lower part of the wheel 40 rests on a bearing projection **38*a* forming the base of the lug 38. The wheel 40 essentially comprises a tooth arrangement 40*a*, an annular bearing projection 40*b*, a shoulder 40*c* provided with a groove 40*d* and a recess 40*e* in which the head of the stud 42 is at least partly housed. The hours disc $D_2$ comprises an axial bore 44 by means of which it is freely rotatably mounted on the wheel 40. The bore is so calculated that the wheel 40 provides for centering of the disc $D_2$ while the support therefor is provided by the bearing projection 40*b*. The minutes disc $D_1$ is fitted by means of its axial bore 46 onto the wheel 40 and rests on the shoulder 40*c*. The disc $D_1$ is fixed with respect to the wheel 40, for example by glue in the groove 40*d*. It is clear that in this way the rigid assembly formed by the disc $D_1$ and the wheel 40 is mounted rotatably about an axis provided by the lug 38. In contrast the disc $D_2$ is free to rotate about the wheel 40 and thus also about the lug 38. It will be seen that the wheel 40 acts both as the wheel 10 and as the spindle 8 in FIG. 2**.

As is well known, the discs are provided at their periphery with toothed rings 48 and 50 which are fixed to the discs by any suitable means. In addition, marks 52 and 54 respectively indicate the hour hand and the minute hand. The glass 34 comprises on its inner face a metal plating at **34*a* for masking the toothed ring 50 and possibly other components. Likewise, on its inner face the disc $D_1$ comprises a ring 56 of metal plating for masking certain components of the watch, the remainder of the disc obviously being transparent. In addition, the disc $D_2$ is opaque in order to mask certain components, including the wheel 40. Finally, the glass 34** also comprises marks indicating the hours or certain hours, on its inner face.

The movement means 12 is preferably journalled on the lug 60 which is an integral part of the bottom of the casing 22. The wheel **12*a* of the movement means engages with the teeth 40*a* of the wheel 40 while the pinion 12*b* of the same movement means engages with the teeth 48** of the disc $D_2$.

The pivot means **6*c* of the movement means 6 are engaged in holes 62 provided in the upper bridge member 20 and the lower bridge member 18, the structure of which will be described in greater detail with reference to FIG. 4. The pivot means 4*c* of the assembly comprising the rotor 4 and the pinion 2 of the motor M are also engaged into holes 68 provided in the bridge members 18 and 20. The wheel 6*a* of the movement means 6 engages with the pinion 2 of the rotor, while the pinion 6*b* of the same movement means engages with the teeth 50** of the disc $D_1$, as already described above.

With regard to FIG. 3, it should be noted that the view is not to true scale, in order to make the drawing clearer. In particular, the dimensions in the direction of the thickness of the watch have been considerably increased with respect to the dimensions in the plane of the watch. In addition, and still for the purpose of making the drawing clearer, the relationship between the diameters of the discs $D_2$ and $D_1$ has been substantially increased. In a particular embodiment, the minutes disc is 16.4 mm in diameter while the hours disc is 11.85 mm in diameter.

Figure 4:
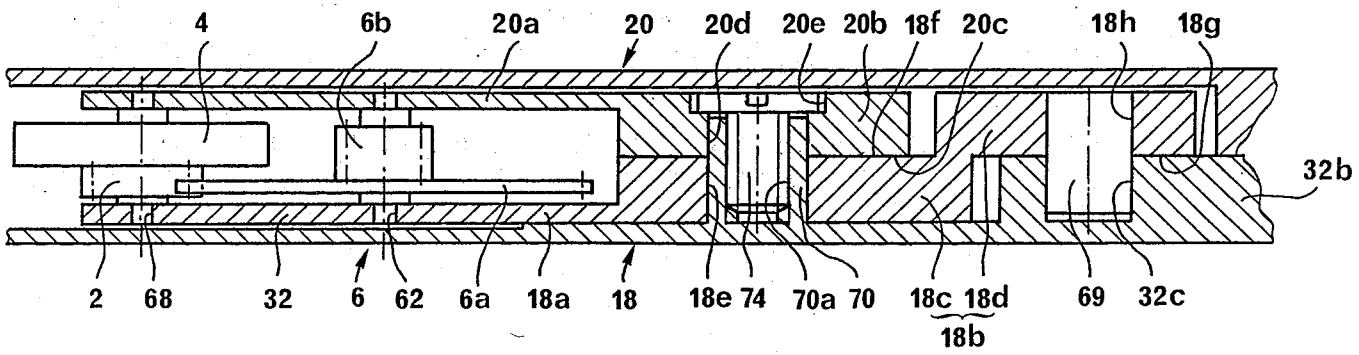
FIG. 4 is a view of details in vertical section taken along line IV—IV in FIG. 1.

FIG. 4 shows a preferred embodiment of the upper and lower bridge members 20 and 18 for mounting the rotor of the motor M and the movement means 6. The lower bridge member 18 which rests on the bottom of the body portion 32 comprises a thin plate-forming portion **18*a* and a fixing portion 18*b* which is thicker. The plate-forming portion 18*a* comprises the holes 62 and 68 for mounting the rotor 4 and the movement means 6. The portion 18*b* itself comprises a part 18*c* which bears against the body portion 32 and a part 18*d* which is raised above the part 18*c* and which bears against an increased-thickness portion 32*b* of the bottom of the body portion 32. The part 18*c* has a bore 18*e* and an upper assembly face 18*f*. The part 18*d* comprises an assembly face 18*g* and bores 18*h* for receiving positioning leg or stem portions 69 which also engage freely into blind holes 32*c* in the thick portion 32*b* of the body portion 32. FIG. 3 shows only one leg or stem portion 69**.

The upper bridge member 20 also comprises a thin plate-forming portion **20*a* and a thick fixing portion 20*b*. The plate-forming portion 20*a* comprises the holes 62 and 68 for mounting the rotor 4 and the movement means 6. The thick portion 20*b* comprises an assembly face 20*c* and a bore 20*d* which is extended in its upper part by a groove 20*e*. Finally, the body portion 32 comprises a lug 70 which is an integral part of the body portion and which has a blind threaded bore 70***a*. It should be added that, as can be seen from FIG. 1, there are other positioning leg or stem portions 72 (there preferably being two thereof) which pass through the thick portions 18*c* and 20*b* of the bridge members 18 and 20 by way of bores which are not shown in FIG. 4. FIG. 4 also does not show the stator, for the sake of clarity of the drawing.

The bridge members 18 and 20 and the means 6 and 4 are set in place in the following manner: the leg or stem portions 69 are placed in their housings 32*c*. The lower bridge member 18 is placed on the body portion 32, being positioned by the portions 69 and the lug 70. The movement means 6 and the rotor 4 are then mounted in the lower bridge member 18. The portions 72 are set in position in their housings in the portion 18*c* of the lower bridge member. The upper bridge member 20 is then set in place by means of the lug 70 and the portions 72. The two bridge members are secured together by screwing the screw 74 into the lug 70. The head 74*a* of the screw 74 comes to bear against the bottom of the groove 20*e*, the effect of which is to cause the assembly faces 18*f* and 20*c* respectively of the upper and lower bridge members to be applied against each other. The thick portions 18*b* and 20*b* thus form a bracing spacer for the thin portions 18*a* and 20*a*.

It will be seen from the description given with reference to FIG. 4 that assembly or dismantly of the two bridge members is easy as it is sufficient to undo one screw. In addition, the plate-forming portions 20*a* and 18*a* are in a cantilevered position with respect to the assembly portions 18*b* and 20*b*, thus freeing the maximum amount of space possible for housing the movement means 6 and the rotor 4. In addition, none of the members for fixing the bridge members to the body portion projects beyond the upper face of the upper bridge member, which reduces the dimension of the assembly in the direction of the thickness.

It will be seen from the whole of the foregoing description of a preferred embodiment of the invention that the aims set out hereinbefore are indeed achieved by the invention. It should also be noted that, by virtue of the design of the watch, the movement means 12 can be party housed below the discs. In addition, the fact that a toothed wheel is placed below the hours disc and the minutes disc does not substantially increase the thickness of the watch, and in any case that thickness is essentially fixed by the thickness of the battery. By way of example, a watch according to the invention was constructed as is 0.98 mm in thickness, 25 mm in width and 30 mm in length.

Various other modifications may be made in the form of the invention without departing from the principles disclosed in the foregoing illustrative embodiments. It is intended therefore that the accompanying claims be construed as broadly as possible consistent with the prior art.

I claim:

1. An electronic watch comprising:

a casing having a front wall provided with a glass, a rear wall, and a side wall connecting the front and rear walls, and, in said casing:

a spindle which is substantially perpendicular to said front and rear walls and which is mounted pivotally with respect to said casing;

a toothed transmission wheel which is secured to said spindle;

a minutes disc which is secured to said spindle and which is perpendicular thereto and which is provided with a tooth arrangement on its periphery;

an hours disc which is mounted pivotally on said spindle, which is substantially parallel to the minutes disc and which is provided with a tooth arrangement on its periphery, said discs being disposed between said glass and said toothed transmission wheel;

an electric motor provided with a rotor and means for supplying and actuating said motor;

a first train of gears engaging with said rotor and said minutes disc; and a second train of gears engaging with said hours disc and said transmission wheel.

2. A watch according to claim 1 wherein the hours disc is mounted on the spindle between said transmission wheel and the minutes disc.

3. A watch according to claim 2 wherein said first gear train comprises a single movement means comprising a wheel engaging with said rotor and a pinion engaging with the minutes disc.

4. A watch according to claim 3 wherein said second gear train comprises a single movement means comprising a wheel engaging with said transmission wheel and a pinion engaging with the hours disc.

5. A watch according to claim 2 wherein said spindle and said transmission wheel form only a single component.

6. A watch according to claim 2 or claim 5 and further comprising a lug which is secured to said rear wall of the casing, wherein said transmission wheel and said spindle are porvided with an axial bore in which said lug freely engages.

7. A watch according to claims 2, 3, 4 or 5 wherein the transmission wheel is provided on its face which is towards the hours disc with an annular bearing projection on which the hours disc rests.

8. A watch according to claim 3 further comprising a lower bridge member resting on said rear wall of the casing, an upper bridge member and means for positioning and fixing said bridge members together and to said rear wall, each bridge member comprising a thin portion forming a plate and a thick portion having an assembly face, said thin portions facing each other and being provided with bores for mounting the rotor and the first movement means, the thick portions bearing against each other by way of their assembly face to form a bracing spacer for the two thin portions.

* * * * *